US006717123B1

(12) United States Patent
Kim

(10) Patent No.: US 6,717,123 B1
(45) Date of Patent: Apr. 6, 2004

(54) WALL-MOUNTED TYPE MICROWAVE OVEN

(75) Inventor: Cheol Jin Kim, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/396,412

(22) Filed: Mar. 26, 2003

(30) Foreign Application Priority Data

Dec. 6, 2002 (KR) ..... 10-2002-0077272

(51) Int. Cl.[7] ..... H05B 6/64
(52) U.S. Cl. ..... 219/757; 126/273 A
(58) Field of Search ..... 219/757, 702, 219/710, 716, 718, 721; 427/386, 387, 388.1; 248/309.1, 674; 126/21 A, 198, 273 A, 229 D, 299 R

(56) References Cited

U.S. PATENT DOCUMENTS 4,327,274 A * 4/1982 White et al. ..... 219/757
4,418,261 A * 11/1983 Jailor et al. ..... 219/757
4,720,622 A * 1/1988 Iwata et al. ..... 219/391
4,796,850 A * 1/1989 Aramaki ..... 248/674
5,986,245 A 11/1999 Kang
6,211,504 B1 * 4/2001 Lee ..... 219/757

* cited by examiner

*Primary Examiner*—Tu Ba Hoang
(74) *Attorney, Agent, or Firm*—Staas & Halsey LLP

(57) ABSTRACT

A wall-mounted type microwave oven includes a cabinet and a hood having a guide duct. The guide duct is movably arranged in the hood, and automatically slides in and out the hood by an actuating unit of the microwave oven. A movable filter is set in the guide duct so as to be spaced apart from an inner surface of the guide duct by a predetermined interval. Where the guide duct is moved forward, exhaust gases generated therebelow pass through the movable filter, and the filtered gases are guided into the cabinet by the guide duct. The actuating unit includes a rotary member and a drive motor mounted on the hood. The rotary member is rotated by the drive motor to move the guide duct forward. The actuating unit further includes an elastic member which is connected, at an end thereof, to the hood and, at the other end thereof, to an inside end of the guide duct. The elastic member provides an elastic force to move the guide duct rearward.

23 Claims, 8 Drawing Sheets

WALL-MOUNTED TYPE MICROWAVE OVEN

CROSS-REFERENCE TO RELATED APPLICATIONS

This application claims the benefit of Korean Patent Application No. 2002-77272, filed Dec. 6, 2002, in the Korean Intellectual Property Office, the disclosure of which is incorporated herein by reference.

BACKGROUND OF THE INVENTION

1. Field of the Invention

The present invention relates to wall-mounted type microwave ovens, and more particularly, to a wall-mounted type microwave oven having a movable filter and a guide duct which are automatically and slidably installed in a hood of the microwave oven.

2. Description of the Related Art

Generally, a wall-mounted type microwave oven is a microwave oven which is mounted to a wall of a kitchen space above a gas range. This type of a microwave oven collaterally vents exhaust gases, smoke, or food odors produced by the gas range into the atmosphere outside of the kitchen space. The wall-mounted microwave oven also performs a cooking operation of food placed therein using high-frequency electromagnetic waves.

A gas range cooks food using heat generated from a combustion of fuel gas. In contrast, a magnetron of the microwave oven generates high-frequency electromagnetic waves to cook food. The microwaves penetrate the food placed in a cooking chamber of the microwave oven so as to repeatedly change the molecular arrangement of moisture laden in the food, thus generating a frictional heat within the food to cook the food.

Similar to the configurations of typical microwave ovens, the conventional wall-mounted type microwave oven includes a cabinet which is partitioned into the cooking chamber and a machine room. However, unlike the typical microwave ovens, the wall-mounted type microwave oven further includes an exhaust path which is defined in the cabinet. The exhaust path guides exhaust gases or food odors produced from food being cooked by the gas range, so as to discharge the exhaust gases or food odors into the atmosphere outside of the kitchen space. Furthermore, an exhaust fan is installed at an upper position of a rear portion of the cabinet, and functions to suck and vent the exhaust gases or food odors guided along the exhaust path.

A hood is mounted to a bottom of the cabinet so as to guide the exhaust gases or food odors into the exhaust path. The hood includes an air inlet port which communicates with the exhaust path.

However, the conventional wall-mounted type microwave oven, which is constructed as described above, does not effectively suck and discharge the exhaust gases, smoke, or food odors produced by the gas range, which is positioned below the microwave oven. That is, since the wall-mounted type microwave oven extends forward from the wall of the kitchen space relatively less than the gas range, the wall-mounted type microwave oven does not sufficiently cover and effectively suck the exhaust gases, smoke, or food odors produced by the gas range. Thus, a portion of the exhaust gases or food odors is not discharged into the atmosphere outside the kitchen space through the wall-mounted type microwave oven. Rather, that portion remains in the kitchen space and contaminates indoor air of the kitchen space, thus leading to an unpleasant environment of the kitchen space.

Furthermore, a filter is provided on the air inlet port of the conventional wall-mounted type microwave oven to remove impurities from the exhaust gases or ambient air. However, the filter of the conventional wall-mounted type microwave oven has an area corresponding to that of the air inlet port, which is relatively small compared to the microwave oven. Accordingly, the filter does not sufficiently remove the impurities from the exhaust gases or food odors provided in the kitchen space.

SUMMARY OF THE INVENTION

Accordingly, it is an aspect of the present invention to provide a wall-mounted type microwave oven which is designed to effectively suck and vent exhaust gases or food odors produced by an oven range which is positioned below the microwave oven.

It is another aspect of the present invention to provide a wall-mounted type microwave oven which is designed to effectively remove impurities from exhaust gases or food odors produced by an oven range.

Additional aspects and advantages of the invention will be set forth in part in the description which follows and, in part, will be obvious from the description, or may be learned by practice of the invention.

To achieve the above and/or other aspects of the present invention, there is provided a wall-mounted type microwave oven comprising a heating unit to cook food, a cabinet which defines an external appearance of the microwave oven, a hood which is mounted to a bottom of the cabinet and includes at least one air inlet port to suck exhaust gas external to the microwave oven into the cabinet, a guide duct which is movably arranged inside the hood at a position above the air inlet port and includes a movable filter that is set in the guide duct so as to be spaced apart from an inner space of the guide duct by a predetermined interval, and an actuating unit which moves the guide duct forward or rearward, wherein the movable filter filters the exhaust gas passing therethrough and the guide duct guides the filtered exhaust gas into the cabinet in response to the guide duct being moved forward by the actuating unit.

The hood may include slide grooves which are provided at sidewalls of the hood, and the guide duct may be slidably fitted at both side ends thereof into the slide grooves so as to move, with the movable filter, along the slide grooves of the hood.

The microwave oven may further comprise a fixed filter which is mounted to the air inlet port and removes impurities from the exhaust gas passing through the air inlet port.

The actuating unit may include a drive motor which is mounted on the hood, a rotary member which is connected, at an end thereof, to a rotating shaft of the drive motor, and rotated by the drive motor to move the guide duct forward, and at least one elastic member which is connected, at a first end thereof, to the hood, while being connected, at a second end thereof, to the guide duct, and applies an elastic force to the guide duct so as to normally move the guide duct rearward.

The rotary member may include an actuating cam which is connected, at an end thereof, to the rotating shaft of the drive motor, and has a curved shape of a predetermined curvature at the other end thereof.

In contrast, the rotary member may include an actuating bar having a predetermined length which is connected, at a first end thereof, to the rotating shaft of the drive motor, and a roller which is connected to a second end of the actuating bar. In this case, the guide duct is moved forward in response to the roller being in contact with a side of the guide duct and revolving on an axis thereof.

The microwave oven may further comprise at least one stopper which is mounted on the hood and stops the guide duct at a predetermined position where the guide duct is moved rearward by the elastic member.

The elastic member may include two coil springs.

The microwave oven may further comprise first and second switches which are mounted on the hood at respective positions corresponding to top and bottom dead centers of the rotary member.

Where the rotary member includes the actuating cam, the microwave oven may further comprise a first micro switch which is mounted on the hood and controls the drive motor to stop a rearward movement of the guide duct, and a second micro switch which is mounted on the hood, positioned behind the drive motor, and controls the drive motor to stop a forward movement of the guide duct. In this case, the drive motor may be a one-way synchronizing motor.

Where the rotary member includes the actuating bar, the microwave oven may further comprise a first micro switch which is mounted on the hood, positioned behind the drive motor, and controls the drive motor to stop a rearward movement of the guide duct, and a second micro switch which is mounted on the hood, positioned in front of the drive motor, and controls the drive motor to stop a forward movement of the guide duct. In this case, the drive motor may be a two-way synchronizing motor.

On the other hand, where the rotary member includes the actuating bar, the microwave oven may further comprise a first micro switch which is mounted on the hood, positioned adjacent to a side of the drive motor, and controls the drive motor to stop a rearward movement of the guide duct, and a second micro switch which is mounted on the hood, positioned in front of the drive motor, and controls the drive motor to stop a forward movement of the guide duct. In this case, the drive motor may be a one-way synchronizing motor.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
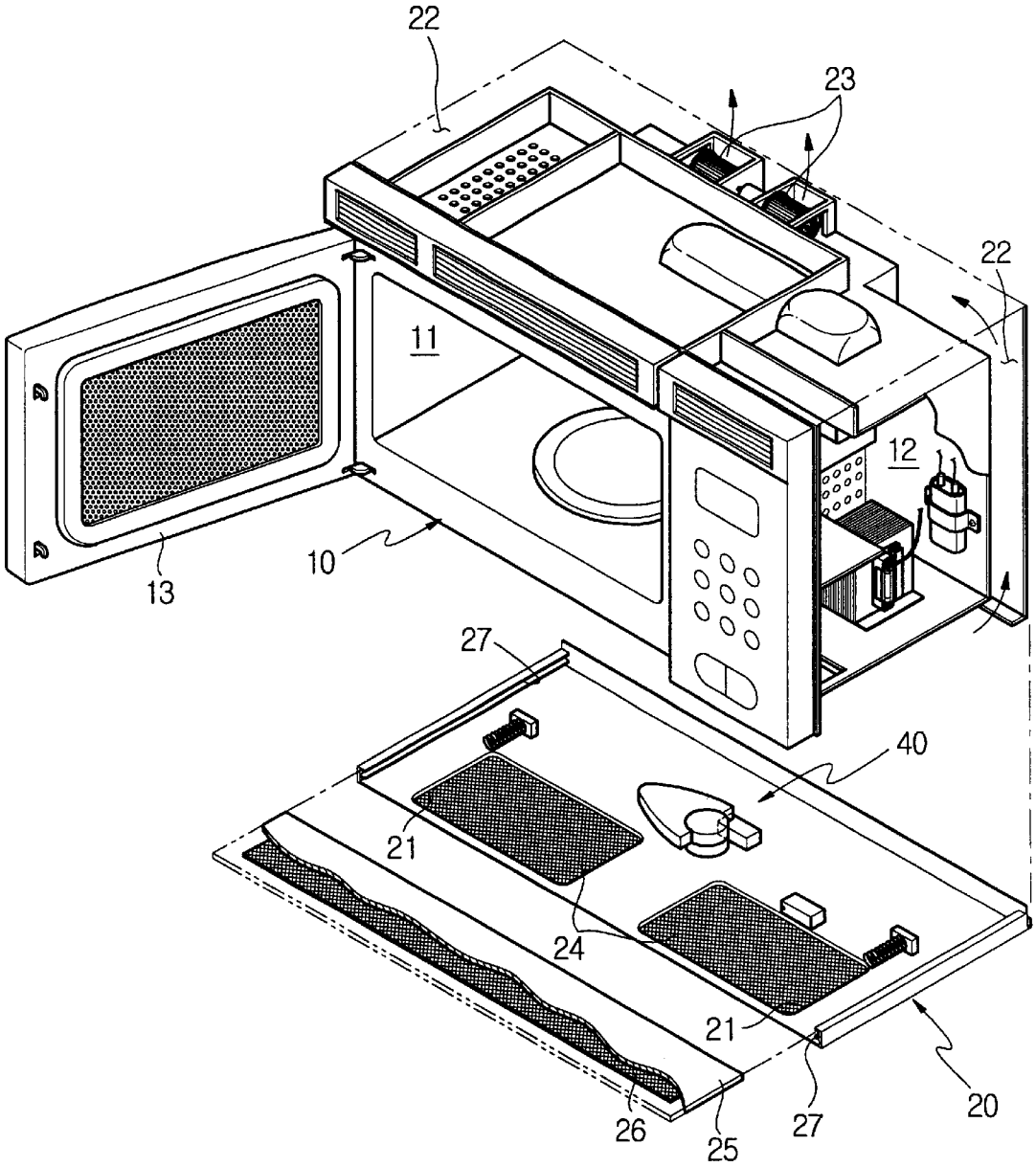
FIG. 1 is an exploded perspective view illustrating a wall-mounted type microwave oven having a hood according to an embodiment of the present invention.

Reference will now be made in detail to the present preferred embodiments of the present invention, examples of which are illustrated in the accompanying drawings, wherein like reference numerals refer to like elements throughout.

FIG. 1 shows an exploded perspective view of a wall-mounted type microwave oven with a hood according to an embodiment of the present invention. As shown in FIG. 1, the wall-mounted type microwave oven includes a cabinet 10 which defines an external appearance of the microwave oven. The cabinet 10 is partitioned into a cooking cavity 11 and a machine room 12. A door 13 is mounted to an open front of the cooking cavity 11 to open or close the cooking cavity 11. Electrical devices are installed in the machine room 12 to irradiate microwaves into the cooking cavity 11 so as to cook food laid in the cooking cavity 11.

A hood 20 is mounted to a bottom of the cabinet 10 to suck exhaust gases or food odors produced by a cooking apparatus, such as an oven range, which is positioned below the microwave oven, and to discharge them into the atmosphere, for example, outside of a cooking space. Two air inlet ports 21 are provided on the hood 20. An exhaust path 22 is defined along a rear wall and both sidewalls of the cabinet 10. Two exhaust fans 23 are installed at upper positions on a rear wall of the cabinet 10.

The air inlet ports 21 are arranged in such a way as to be in parallel to each other at a front portion of the hood 20. A fixed filter 24 is mounted to each air inlet port 21 to remove impurities from the exhaust gases.

The hood 20 further includes a guide duct 25, a movable filter 26, and an actuating unit 40. The actuating unit 40 functions to automatically slide the guide duct 25 and the movable filter 26 so as to have the guide duct 25 and the movable filter 26 advance forward from the hood 20 or retract into the hood 20.

The movable filter 26 is set in the guide duct 25 so as to be spaced apart from an inner surface of the guide duct 25 by a predetermined interval, and is moved along with the guide duct 25. The guide duct 25 is slidably fitted, at both side ends thereof, into slide grooves 27 provided at both sidewalls of the hood 20. Accordingly, the guide duct 25, along with the movable filter 26, is slidably moved along the slide grooves 27.

Where the guide duct 25 is automatically and slidably moved forward along the slide grooves 27 of the hood 20 by the actuating unit 40, the movable filter 26 is moved forward along with the guide duct 25. Accordingly, the exhausted gases or food odors produced by the cooking apparatus, which is positioned below the microwave oven, are sucked into the cabinet 10 through the guide duct 25 as well as the air inlet ports 21 of the hood 20. That is, where the guide duct 25 and the movable filter 26 are forwardly advanced from the cabinet 10, a portion of the exhaust gases or food odors are sucked through the air inlet ports 21 and the fixed filters 24 to be filtered, while the remaining exhaust gases or food odors pass through the movable filter 26 to be filtered. In this case, the filtered exhaust gases or food odors from the movable filter 26 are sucked into the cabinet 10 along the guide duct 25. Thus, where extended forward from the microwave oven, the guide duct 25 with the movable filter 26 increases the area of the hood 20 to more effectively suck and exhaust the exhaust gases or food odors.

Figure 2:
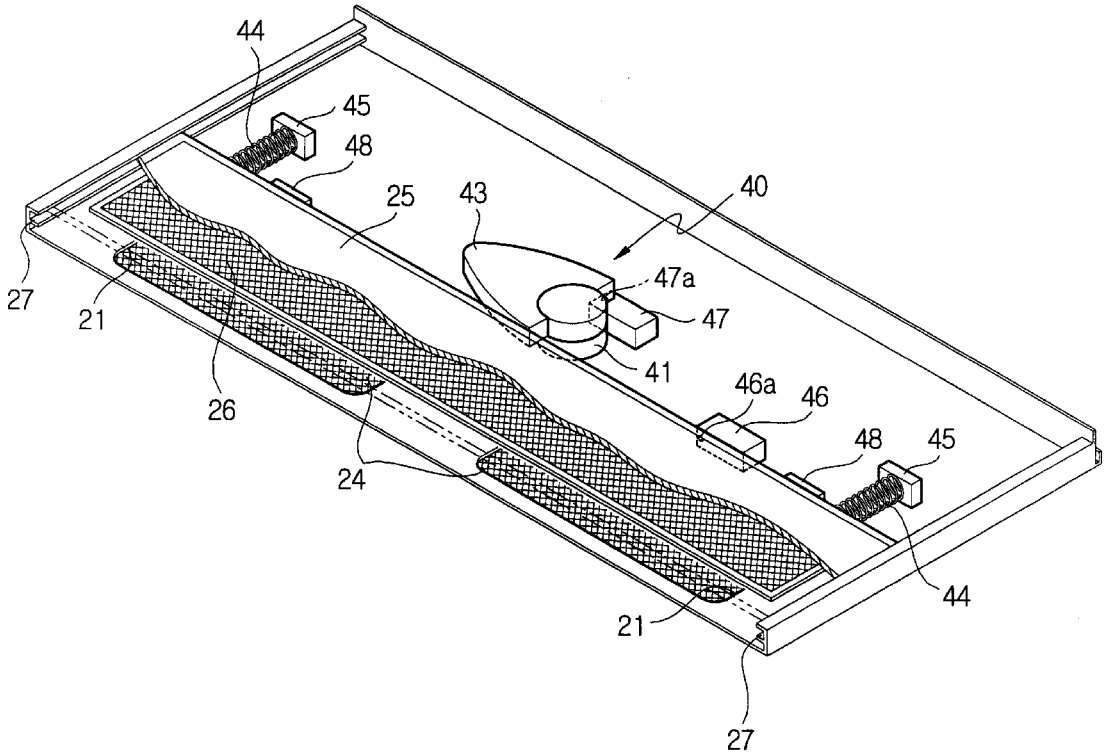
FIG. 2 is a perspective view illustrating the hood shown in FIG. 1 having a guide duct and an actuating unit according to the present invention.
Figure 3:
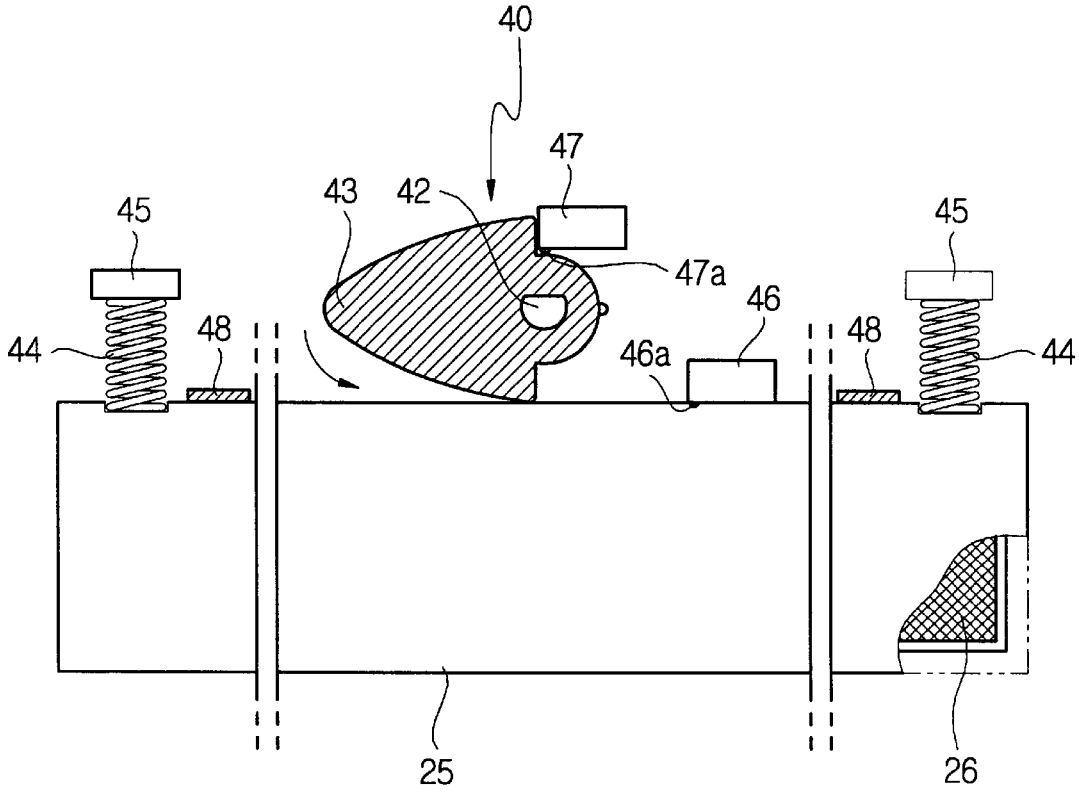
FIG. 3 is a plan view illustrating the guide duct and the actuating unit shown in FIG. 2 with the guide duct being moved rearward by the actuating unit.
Figure 4:
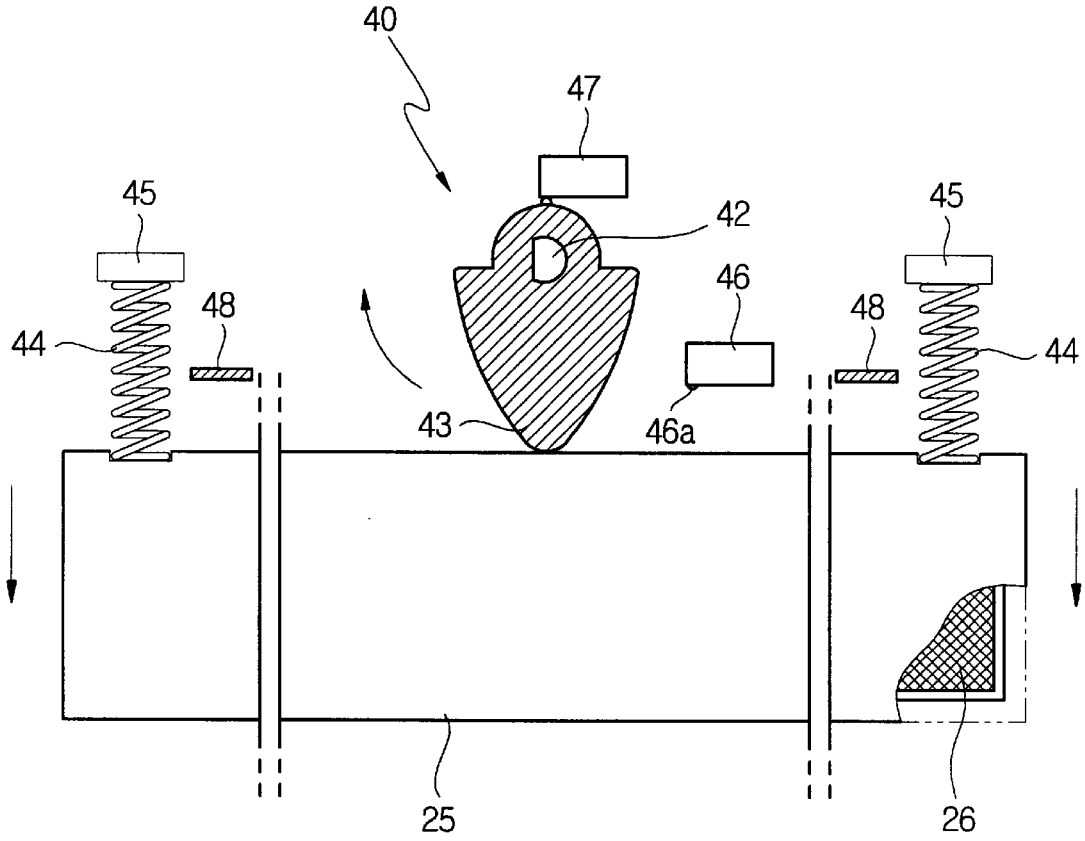
FIG. 4 is a plan view illustrating the guide duct and the actuating unit shown in FIG. 2 with the guide duct being moved forward by the actuating unit.

FIGS. 2 to 4 show the configuration and effect of the actuating unit 40 of the microwave shown in FIG. 1. Specifically, FIG. 2 shows a schematic perspective view of the hood 20 to which the guide duct 25, the movable filter 26, and the actuating unit 40 are mounted. FIGS. 3 and 4 illustrate the guide duct 25 with the movable filter 26 moved forward and rearward by an operation of the actuating unit 40, respectively.

As shown in FIG. 2, the actuating unit 40 includes a drive motor 41, an actuating cam 43, and two elastic members 44. The drive motor 41 is fixedly mounted on the hood 20. The actuating cam 43 serves as a rotary member, and is connected, at an end thereof, to a rotating shaft 42 (see, FIG. 2) of the drive motor 41 to be rotated around the end. Each of the elastic members 44 is connected, at both ends thereof, to an inside end of the guide duct 25 and the hood 20 so as to normally and elastically move the guide duct 25 rearward.

Two brackets 45 are mounted on both sides of the hood 20, so as to fix each elastic member 44, at its end, to the hood 20. The elastic member 44 may be, for example, a coil spring. It is understood that the elastic member 44 may be a device which applies an elastic force that moves the guide duct 25 rearward.

A first micro switch 46 is mounted on the hood 20, detects whether the guide duct 25 with the movable filter 26 is moved rearward to cover the air inlet ports 21, and controls an operation of the drive motor 41 to stop a rearward movement of the guide duct 25 at a predetermined position. A second micro switch 47 is mounted on the hood 20 so as to be positioned, for example, behind the drive motor 41, detects whether the guide duct 25 with the movable filter 26 is moved forward, and controls an operation of the drive motor 41 to stop a forward movement of the guide duct 25 at a predetermined position.

Two stoppers 48 are mounted on the hood 20 and stop the guide duct 25 at a predetermined position. That is, the inside end of the guide duct 25 moving rearward comes into contact with the two stoppers 48 at the predetermined position, thus halting movement.

The actuating cam 43 has a length corresponding to a moving distance of the guide duct 25, and has a curved shaped of a predetermined curvature. The actuating cam 43 moves the guide duct 25 forward while being in contact with the inside end of the guide duct 25.

An operation of the actuating unit 40 will be described with reference to FIGS. 3 and 4. FIG. 3 shows the guide duct 25 being moved rearward by the actuating unit 40. FIG. 4 shows the guide duct 25 being moved forward by the actuating unit 40.

As shown in FIG. 3, where the guide duct 25 is retracted rearward, the actuating cam 43 is positioned parallel to a length of the guide duct 25. In this case, the guide duct 25 with the movable filter 26 is moved rearward by a restoring force of the elastic member 44, and is stopped at a predetermined position by the stoppers 48.

Where the guide duct 25 is moved rearward to the predetermined position, the inside end of the guide duct 25 depresses a button 46*a* of the first micro switch 46, thus stopping the drive motor 41.

To extend the guide duct 25 forward and more effectively suck the exhaust gases or food odors through the hood 20, the drive motor 41 operates to rotate the rotating shaft 42 in a manner shown by the arrow of FIG. 3. In response, the rotating shaft 42 rotates the actuating cam 43 in a direction of the arrow, and the actuating cam 43 having the curved shape pushes the inside end of the guide duct 25. Accordingly, each elastic member 44 is extended at an end thereof and provides a restoring force to later return the guide duct 25 rearward.

As shown in FIG. 4, where a front end of the actuating cam 43 comes into contact with the inside end of the guide duct 25, a button 47*a* of the second micro switch 47 is depressed by the actuating cam 43 to indicate that the guide duct 25 has been forwardly moved to a predetermined position. Where the guide duct 25 is forwardly moved to the predetermined position, the drive motor 41 is stopped, so as to stop a further forward movement of the guide duct 25.

Where the guide duct 25 with the movable filter 26 is forwardly moved away from the cabinet 10, a portion of the exhaust gases or food odors is sucked through the air inlet ports 21 and the fixed filters 24, and the remaining portion of the exhaust gases or food odors are sucked into the cabinet 10 through the guide duct 25 and the movable filter 26. Accordingly, the present microwave oven allows a larger quantity of the exhaust gases or food odors to be rapidly vented into the atmosphere compared to a conventional microwave oven.

Where the drive motor 41 is operated again, in a state where the guide duct 25 with the movable filter 26 is moved forward, the actuating cam 43 is rotated in a direction illustrated by the arrow of FIG. 4. At this time, the guide duct 25 is retracted into the hood 20 by the restoring force of the elastic members 44. The retracted guide duct 25 is halted by the stoppers 48, and the rearward movement of the guide duct 25 is stopped. Where the button 46*a* of the first micro switch 46 is depressed by the guide duct 25 at this time, the drive motor 41 is stopped.

Figure 5:
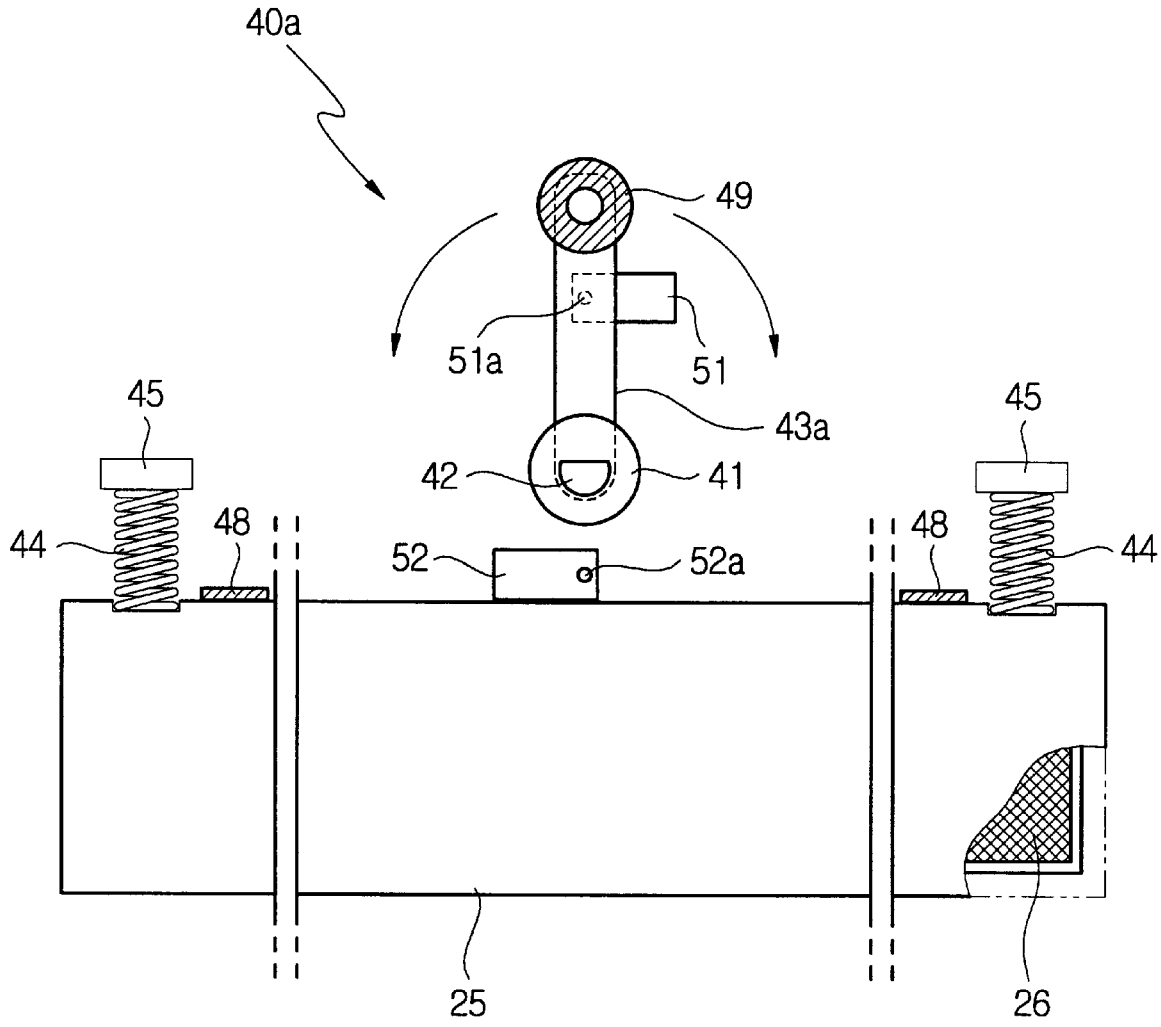
FIG. 5 is a plan view illustrating a guide duct and an actuating unit of a wall-mounted type microwave oven according to another embodiment of the present invention, with the guide duct being moved rearward by the actuating unit.
Figure 6:
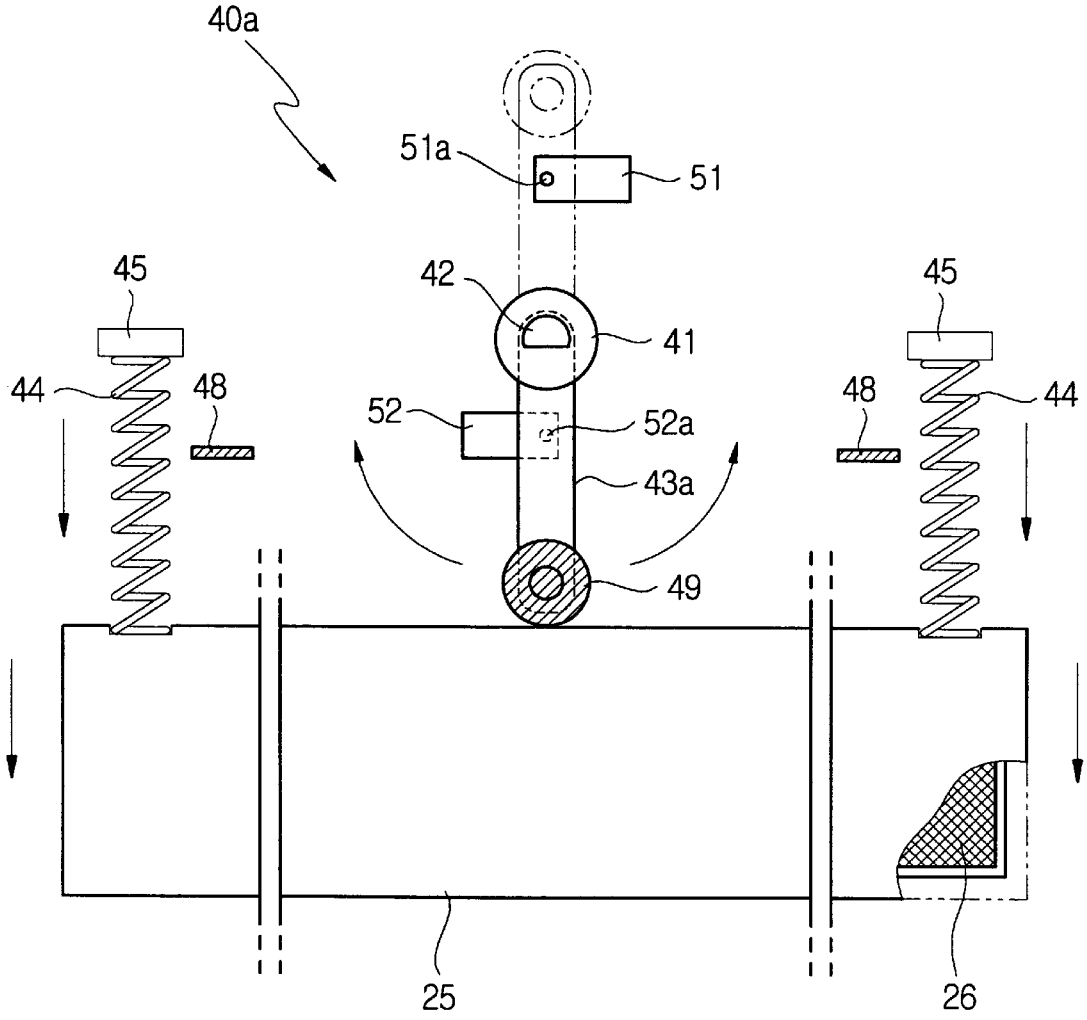
FIG. 6 is a plan view illustrating the guide duct and the actuating unit shown in FIG. 5 with the guide duct being moved forward by the actuating unit.

FIGS. 5 and 6 show an actuating unit of a wall-mounted type microwave oven according to another embodiment of the present invention. FIG. 5 shows the guide duct 25 and the movable filter 26 being moved rearward by the actuating unit 40*a*. FIG. 6 shows the guide duct 25 and the movable filter 26 being moved forward by the actuating unit 40*a*.

As shown in FIGS. 5 and 6, the actuating unit 40*a* has a configuration similar to the actuating unit 40 of FIGS. 2–4, except that the actuating unit 40*a* is provided with an actuating bar 43*a* as a rotary member corresponding to the actuating cam 43 of the actuating unit 40.

That is, the actuating unit 40*a* includes a drive motor 41, the actuating bar 43*a*, two elastic members 44, a first micro switch 51, a second micro switch 52, and two stoppers 48. The drive motor 41 is mounted on the hood 20. The actuating bar 43*a* is connected, at an end thereof, to a rotating shaft 42 of the drive motor 41. The elastic members 44 are connected at their respective first ends to corresponding brackets 45, while being connected at their second ends to the inside end of the guide duct 25. The first micro switch 51 is mounted on the hood 20 so as to be positioned, for example, behind the drive motor 41, and controls an operation of the drive motor 41 to stop the guide duct 25 from moving rearward. The second micro switch 52 is mounted on the hood 20 so as to be positioned, for example, in front of the drive motor 41, and controls an operation of the drive motor 41 to stop the guide duct 25 from moving forward. The stoppers 48 are mounted on the hood 20 to stop the guide duct 25 at a predetermined position where the guide duct 25 is moved rearward.

The actuating bar 43*a* has a length corresponding to the moving distance of the guide duct 25, and is provided at an end opposite to the end which is connected to the rotating shaft 42, with a roller 49. The roller 49 may contact with the inside end of the guide duct 25 in such a way as to revolve on its axis, thus allowing the guide duct 25 to be smoothly moved forward.

The drive motor 41 may comprise a two-way synchronizing motor to reduce the cost of components thereof. Such a two-way synchronizing motor allows the actuating bar 43*a* to be rotated clockwise or counterclockwise, so that the roller 49 provided at the end of the actuating bar 43*a* comes into contact with the inside end of the guide duct 25.

The actuating unit 40*a* is operated as follows, to move the guide duct 25 and the movable filter 26 forward or rearward.

As shown in FIG. 5, where the guide duct 25 is moved rearward, the guide duct 25 is positioned so to be in contact with the stoppers 48 by an elastic force of the elastic members 44. At this time, a button 51*a* of the first micro switch 51 is depressed by a projection (not shown) which is extended from a lower surface of the actuating bar 43, thus stopping the drive motor 41.

Where the drive motor 41 is operated in such a state, the actuating bar 43*a* is rotated clockwise or counterclockwise as illustrated by the arrows of FIG. 5. At this time, the roller 49 contacts and pushes the inside end of the guide duct 25 so as to move the guide duct 25 forward. Such a forward movement of the guide duct 25 is stopped where the projection extending from the lower surface of the actuating bar 43*a* depresses a button 52*a* of the second micro switch 52 to stop the drive motor 41, as illustrated in FIG. 6. Where the guide duct 25 moves forward, the elastic members 44 are extended. The guide duct 25 and the movable filter 26 are moved rearward by, for example, a restoring force of the extended elastic members 44.

Where the drive motor 41 is operated again in a state where the guide duct 25 and the movable filter 26 are moved forward, the roller 49 is later separated from the inside end of the guide duct 25. At this time, the guide duct 25 and the movable filter 26 are moved rearward by the restoring force of the elastic members 44, as illustrated in FIG. 5. Where the actuating bar 43*a* depresses the button 51 a of the first micro switch 51, the drive motor 41 is stopped.

Figure 7:
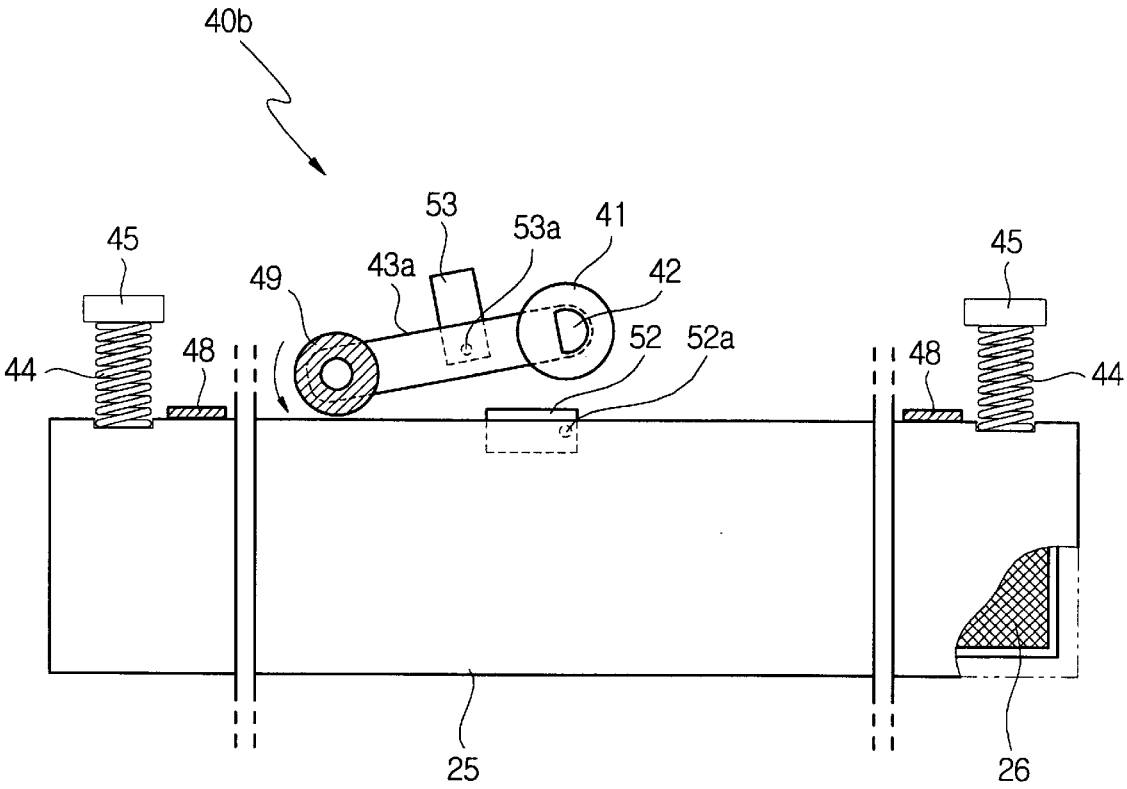
FIG. 7 is a plan view illustrating a guide duct and an actuating unit of a wall-mounted type microwave oven according to yet another embodiment of the present invention, with the guide duct being moved rearward by the actuating unit.
Figure 8:
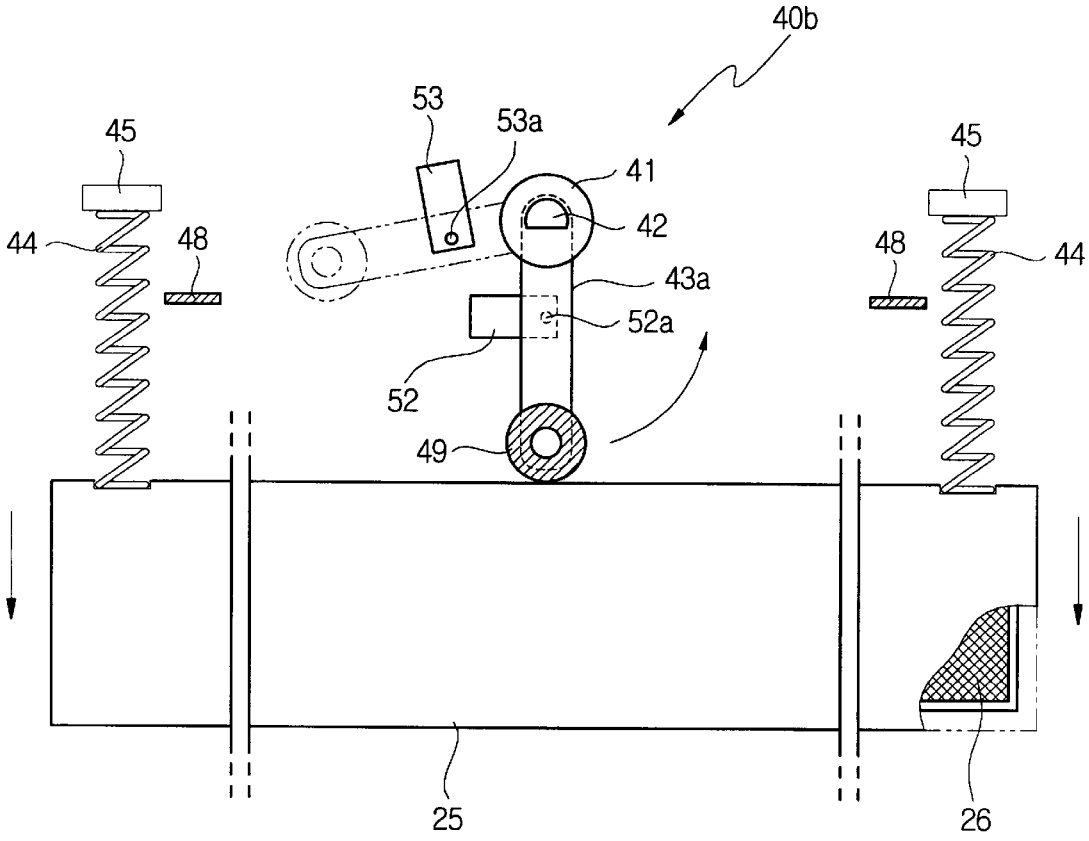
FIG. 8 is a plan view illustrating the guide duct and the actuating unit shown in FIG. 7 with the guide duct being moved forward by the actuating unit.

FIGS. 7 and 8 show an actuating unit of a wall-mounted type microwave oven according to yet another embodiment of the present invention. FIG. 7 shows the guide duct 25 and the movable filter 26 being moved rearward by an actuating unit 40*b*. FIG. 8 shows the guide duct 25 and the movable filter 26 being moved forward by the actuating unit 40*b*.

As shown in FIGS. 7 and 8, the actuating unit 40*b* has the same configuration as the actuating unit 40*a* of FIGS. 5 and 6 except that a first micro switch 53, having the same function as the first micro switch 51 of FIGS. 5 and 6, is positioned at a position adjacent to a side of the drive motor 41, and the drive motor 41 comprises a one-way synchronizing motor.

Where the guide duct 25 is moved rearward as illustrated in FIG. 7, an actuating bar 43*a* of the actuating unit 40*b* is positioned adjacent to the inside end of the guide duct 25. That is, where a button 53*a* of the first micro switch 53, which is provided at a left side of the drive motor 41, is depressed by a projection (not shown) downwardly extending from the actuating bar 43*a*, the rearward movement of the guide duct 25 is stopped.

Where the drive motor 41 comprising the one-way synchronizing motor is operated in such a state, the actuating bar 43*a* is rotated in a direction illustrated by the arrow of FIG. 7. At this time, the roller 49 pushes the inside end of the guide duct 25 to rapidly move the guide duct 25 and the movable filter 26 forward.

Such a forward movement of the guide duct 25 is stopped where the projection of the actuating bar 43*a* depresses a button 52*a* of the second micro switch 52 mounted on the hood 20.

Where the drive motor 41 is operated again in a state where the guide duct 25 is moved forward, the actuating bar 43*a* is rotated in a direction illustrated by the arrow of FIG. 8 to return to the position illustrated in FIG. 7. During the rotation of the actuating bar 43*a*, the button 53*a* of the first micro switch 53 is depressed by the projection, thus stopping the drive motor 41. At this time, the actuating bar 43*a* is returned to the position illustrated in FIG. 7 in such a way as to be adjacent to the guide duct 25, thus allowing the guide duct 25 to be rapidly moved rearward. The guide duct 25 is retracted into the hood 20 by a restoring force of the elastic members 44, and is stopped at a predetermined position by the stoppers 48.

As described above, the present invention provides a wall-mounted type microwave oven having a hood, and a guide duct and a movable filter which are installed in the hood so as to selectively slide in and out the hood. Where the guide duct with the movable filter are extended forward from the hood, exhaust gases and food odors generated therebelow are more effectively sucked into an exhaust path of the microwave oven, thus keeping the environment of a cooking space more pleasant.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A wall-mounted type microwave oven comprising:

a heating unit to cook food;

a cabinet which defines an external appearance of the microwave oven;

a hood which is mounted to a bottom of the cabinet and provided with at least one air inlet port to suck exhaust gas external to the microwave oven into the cabinet;

a guide duct which is movably arranged inside the hood at a position above the air inlet port, and includes a movable filter that is set in the guide duct so as to be spaced apart from an inner surface of the guide duct by a predetermined interval; and an actuating unit which moves the guide duct forward or rearward, wherein the movable filter filters the exhaust gas passing therethrough and the guide duct guides the filtered exhaust gas into the cabinet in response to the guide duct being moved forward by the actuating unit.

2. The wall-mounted type microwave oven as set forth in claim 1, wherein:

the hood includes slide grooves which are provided at sidewalls of the hood, and the guide duct is slidably fitted at both side ends thereof into the slide grooves so as to move, with the movable filter, along the slide grooves of the hood.

3. The wall-mounted type microwave oven as set forth in claim 2, further comprising a fixed filter which is mounted to the air inlet port and removes impurities from the exhaust gas passing through the air inlet port.

4. The wall-mounted type microwave oven as set forth in claim 2, wherein the actuating unit comprises:

a drive motor which is mounted on the hood;

a rotary member which is connected, at an end thereof, to a rotating shaft of the drive motor, and rotated by the drive motor to move the guide duct forward; and at least one elastic member which is connected, at a first end thereof, to the hood, while being connected, at a second end thereof, to the guide duct, and applies an elastic force to the guide duct so as to normally move the guide duct rearward.

5. The wall-mounted type microwave oven as set forth in claim 4, wherein the rotary member comprises an actuating cam which is connected, at an end thereof, to the rotating shaft of the drive motor, and has a curved shape of a predetermined curvature at the other end thereof.

6. The wall-mounted type microwave oven as set forth in claim 4, wherein:

the rotary member comprises:

an actuating bar having a predetermined length which is connected, at a first end thereof, to the rotating shaft of the drive motor; and a roller which is connected to a second end of the actuating bar, and the guide duct is moved forward in response to the roller being in contact with a side of the guide duct and revolving on an axis thereof.

7. The wall-mounted type microwave oven as set forth in claim 4, wherein the elastic member comprises two coil springs.

8. The wall-mounted type microwave oven as set forth in claim 4, further comprising at least one stopper which is mounted on the hood and stops the guide duct at a predetermined position where the guide duct is moved rearward by the elastic member.

9. The wall-mounted type microwave oven as set forth in claim 5, further comprising first and second micro switches which are mounted on the hood, wherein:

the first micro switch controls the drive motor to stop the guide duct from moving rearward, and the second micro switch is positioned behind the drive motor and controls the drive motor to stop the guide duct from moving forward.

10. The wall-mounted type microwave oven as set forth in claim 6, further comprising first and second micro switches which are mounted in the hood, wherein:

the drive motor comprises a two-way synchronizing motor, the first micro switch is positioned behind the drive motor and controls the drive motor to stop the guide duct from moving rearward, and the second micro switch is positioned in front of the drive motor and controls the drive motor to stop the guide duct from moving forward.

11. The wall-mounted type microwave oven as set forth in claim 6, further comprising first and second micro switches which are mounted in the hood, wherein:

the drive motor comprises a one-way synchronizing motor, the first micro switch is positioned adjacent to a side of the drive motor and controls the drive motor to stop the guide duct from moving rearward, and the second micro switch is positioned in front of the drive motor and controls the drive motor to stop the guide duct from moving forward.

12. The wall-mounted type microwave oven as set forth in claim 1, further comprising an exhaust unit which draws the exhaust gas into an exhaust path of the cabinet and discharges the exhaust gas to the outside of a cooking space, wherein the microwave oven is provided in the cooking space.

13. The wall-mounted type microwave oven as set forth in claim 1, wherein the guide duct provides an additional coverage area to guide the exhaust gas, which is beyond a parameter of the hood, to the air inlet port of the hood in response to the guide duct being moved forward by the actuating unit.

14. The wall-mounted type microwave oven as set forth in claim 1, wherein a portion of the exhaust gas is sucked through the air inlet port, and the remaining exhaust gas is provided to the air inlet port of the cabinet through the movable filter and the guide duct where the guide duct having the movable filter is extended forward.

15. The wall-mounted type microwave oven as set forth in claim 5, wherein the actuating cam has a length corresponding to a moving distance of the guide duct.

16. The wall-mounted type microwave oven as set forth in claim 6, wherein the actuating bar has a length corresponding to a moving distance of the guide duct.

17. The wall-mounted type microwave oven as set forth in claim 6, wherein the guide duct is moved forward in response to the roller being in contact with the side of the guide duct and revolving on the axis thereof, as the actuating bar is rotated by the drive motor.

18. A wall-mountable cooking apparatus for a cooking space, comprising:

a heating unit to cook food;

a cabinet which defines an external appearance of the cooking apparatus;

a hood which is mounted to a bottom of the cabinet and provided with at least one air inlet port to draw exhaust gas external to the cooking apparatus into the cabinet;

a guide duct which is movably arranged inside the hood at a position above the air inlet port, and includes a movable filter that is set in the guide duct so as to be spaced apart from an inner surface of the guide duct by a predetermined interval; and an actuating unit which moves the guide duct forward or rearward, wherein a portion of the exhaust gas is sucked through the air inlet port, and the remaining exhaust gas is provided to the air inlet port of the cabinet through the movable filter and the guide duct where the guide duct is extended forward.

19. The wall-mountable coking apparatus as set forth in claim 18, further comprising an exhaust unit which draws the exhaust gas into the cabinet and discharges the exhaust gas to the outside of the cooking space.

20. The wall-mountable coking apparatus as set forth in claim 18, further comprising a fixed filter which is mounted to the air inlet port, wherein the portion of the exhaust gas is filtered by the fixed filter, and the remaining exhaust gas is first filtered by the movable filter and then filtered by the fixed filter where the guide duct is extended forward.

21. The wall-mountable coking apparatus as set forth in claim 18, further comprising a micro switch unit which is mounted on the hood and controls the actuating unit to selectively stop the guide duct from moving forward and rearward.

22. The wall-mountable coking apparatus as set forth in claim 18, wherein the guide duct provides an additional coverage area to guide the exhaust gas, which is beyond a parameter of the hood, to the air inlet port of the hood in response to the guide duct being moved forward by the actuating unit.

23. The wall-mountable coking apparatus as set forth in claim 18, wherein the heating unit includes a magnetron which generates microwave to cook the food.

* * * * *

UNITED STATES PATENT AND TRADEMARK OFFICE

CERTIFICATE OF CORRECTION

PATENT NO. : 6,717,123 B1
DATED : April 6, 2004
INVENTOR(S) : Cheol Jin Kim

It is certified that error appears in the above-identified patent and that said Letters Patent is hereby corrected as shown below:

Column 10,
Lines 58 and 62, change “coking” to -- cooking --

Column 11,
Lines 1 and 6, change “coking” to -- cooking --

Column 12,
Line 4, change “coking” to -- cooking --

Signed and Sealed this

Twenty-ninth Day of June, 2004

JON W. DUDAS
*Acting Director of the United States Patent and Trademark Office*